United States Patent [19]

Summons et al.

[11] Patent Number: 4,863,014

[45] Date of Patent: Sep. 5, 1989

[54] TRANSPARENT BUILDING INDUSTRY PRODUCT WITH COLLAPSIBLE TUBE

[75] Inventors: Wayne L. Summons, Littleton; Lester G. Burch, Arvada, both of Colo.

[73] Assignee: Sashco, Inc., Commerce City, Colo.

[21] Appl. No.: 255,840

[22] Filed: Oct. 7, 1988

Related U.S. Application Data

[63] Continuation-in-part of Ser. No. 895,128, Aug. 11, 1986, Pat. No. 4,776,458.

[51] Int. Cl.[4] ..... B61D 79/00

[52] U.S. Cl. ..... 206/45.31; 206/229; 206/277; 206/459; 220/75; 220/82 R; 222/541

[58] Field of Search ..... 220/75, 82 R; 222/541; 206/45.31, 45.33, 229, 277, 459

[56] References Cited

U.S. PATENT DOCUMENTS

| | | | |
|---|---|---|---|
| 2,362,817 | 11/1944 | Haycock | 220/75 |
| 3,363,811 | 1/1968 | Gels, Sr. | 222/541 |
| 3,530,723 | 9/1970 | Hogue et al. | 220/82 R |
| 3,716,169 | 2/1973 | Chivers | 220/82 R |
| 3,884,396 | 5/1975 | Gordon et al. | 222/541 |
| 4,299,329 | 11/1981 | Keiji | 220/541 |
| 4,545,483 | 10/1985 | Shiba et al. | 220/82 R |

*Primary Examiner*—Joseph Man-Fu Moy

*Attorney, Agent, or Firm*—Timothy J. Martin; J. Preston Oxenham

[57] ABSTRACT

A product for the building industry includes a container having opposed transparent sidewall portions and a transparent caulking compound contained therein so that the appearance of a substrate surface with the caulking compound may be previewed before actual application of the caulk. A dispensing nozzle is provided at a downstream end and has a resealable cap. The container has a flexible sidewall that is flattened at an upstream end to form a region of reduced thickness so that a mass of caulking compound therein has a flattened configuration with this mass confined between the facing transparent sidewall portions. Preferably the entire sidewall is transparent and has index markings correlated to available bead length of the caulk remaining in the container. The flexible sidewall permits manual dispensing and allows a crease to be made thereby forming a preview packet.

17 Claims, 3 Drawing Sheets

TRANSPARENT BUILDING INDUSTRY PRODUCT WITH COLLAPSIBLE TUBE

BACKGROUND OF THE INVENTION

This application is a continuation-in-part of our copending U.S. patent application Ser. No. 895,128 issued as U.S. Pat. No. 4,776,458 on Oct. 11, 1988.

The present invention extends the teachings of that application to now include a material container for materials having organic solvent components wherein the container has a flexible sidewall which may be collapsed to dispense the material contained therein.

As discussed in our earlier application, the disclosure of which is incorporated herein by reference, certain materials which employ organic solvent components have commonly been packaged or stored in glass containers, metal containers, or cardboard containers, with the latter especially being used in the case of viscous materials of the caulking, sealing and adhesive compound class. Typically, with respect to the containment of caulking compounds, the common manner of packaging these products for commercial distribution is an elongated cardboard tube having a nozzle at one end and a moving piston at the other end. A disadvantage of such packaging is that the consumer cannot see the contents of the package and cannot see through the package and material placed therein in order to view how the caulking compound will appear on the substrate upon which the caulking material is intended to be placed.

In our U.S. Pat. No. 4,776,458, we developed and disclosed a cartridge formed as an elongated tubular housing have a longitudinal axis and a surrounding sidewall fabricated of transparent material. This cartridge has a hollow interior and is enclosed at one end by a nozzle member and at another end by a slideable piston member. In one embodiment described in our patent, this cartridge is then filled with a substantially transparent caulking compound to produce a product for use in the building industry in the form of a combination of the housing and caulking compound which is substantially transparent in a transverse direction that allows a user to see completely through the surrounding sidewall and through the caulking compound from one side of the cartridge to the other. This produce allows a substrate surface to be viewed through the combination housing and caulking material so the appearance of the substrate as affected by the caulking may be seen prior to the application of the caulking material and whereby the position of the piston number may be viewed as the caulking material is dispensed from the housing.

While the above-described product represented a significant step in providing a product for use in the building industry (which also includes the home repair industry) there still remained a need for improved packaging techniques that are especially useful for conveying the transparent properties of a transparent caulking compound at the point of sale. There was a further need for such packaging which could offer smaller quantities of the product for purchase in the manner described above. There is a further need for such packaging which is less expensive in order to justify packaging smaller portions of the transparent caulking compound.

SUMMARY OF THE INVENTION

It is an object of the present invention to provide a new and useful product for the building industry in the form of a collapsible container which houses a substantially transparent caulking compound wherein the container includes a visible portion through which a consumer may preview the caulking compound as it is applied to an underlying substrate surface.

It is another object of the present invention to provide an inexpensive container and caulking compound product which is inexpensive to manufacture and produce so as to justify selling small quantities of the caulking compound while providing preview ability.

It is a further object of the present invention to provide a product for the building industry including a substantially transparent caulking compound having highly volatile components which is housed in a container that is substantially transparent so that a view may preview application of the caulking compound to a substrate surface before dispensing the same.

It is a still further object of the present invention to provide a caulking compound container that is indexed so as to correlate the remaining mass of caulking material to the length of a standard caulking bead which may be applied and wherein the container may have sufficient flexibility to be creased in the transverse direction with the crease line registering with the index markings to register such amount.

It is yet another object of the present invention to provide a container and caulking compound product which has sufficient flexibility so that the container may be creased to form a packet having substantially uniform thickness to facilitate preview of application of the caulking compound onto a selected substrate surface.

The present invention, therefore, provides for a combination container and caulking compound material. In its broad form, this product comprises an elongated container having a longitudinal axis and an interior with this container including a surrounding sidewall, a first closure forming a downstream end of the container and a second closure forming an upstream end of the container. A dispensing nozzle extends outwardly from the container at the downstream end thereof and has a flow passageway in fluid communication with the interior. A substantially transparent caulking compound is contained in the interior of this container, and the sidewall is fabricated out of a flexible material whereby the container may be manually squeezed to dispense the caulking compound as an applied bead out of the dispensing nozzle and onto a selected substrate surface. The container further has a region of reduced thickness in a direction transverse to the longitudinal axis with this region of reduced thickness being located longitudinally adjacent the upstream end of the container so that the caulking compound in the region of reduced thickness has a substantially uniform, flattened configuration. The surrounding sidewall further has facing sidewall portions on opposite sides of the region of reduced thickness which sidewall portions are fabricated of substantially transparent material so that the substrate surface may be viewed through the combination of the facing sidewall portions and the caulking material therebetween thus allowing a preview of the appearance of the substrate surface as it will be affected by the caulking material prior to the application of the caulking material.

In the preferred form of the present invention, the entire sidewall is constructed of transparent material that may be printed with whatever graphics are pleasing to the seller. Preferably, this sidewall includes a layer of high barrier material resistant to the migration of volatile vapors from the caulking compound placed within the container. This layer may conveniently be amorphous nylon. The sidewall can be constructed of a single layer of material but also may be constructed of laminate layers, at lease one of which is the layer of high barrier material. Preferably, the caulking compound is a block compolymer rubber and can be tinted with a selected color.

In the preferred embodiment, the sidewall is formed of a tubular construction with the second closure being formed by collapsing and sealing a second end portion of the sidewall against itself along a linear region transverse to the longitudinal axis. In this configuration, the upstream end of the container is thus circular in cross-section. The first closure may be formed integrally with the surrounding sidewall and, preferably, the nozzle is formed integrally with the first closure and is located centrally thereon so that the nozzle projects longitudinally of the container. The nozzle may also be provided with a resealable end cap so that the caulking compound may be selectively dispensed and stored without degradation.

The sidewall further has sufficient flexibility so that it may be transversely creased along the crease line at a location downstream of the upstream end in order to trap a mass of caulking compound between the crease line and the second closure thus forming a packet of caulking compound that has a uniform dimensional thickness to facilitate preview of the substrate surface as affected by the caulking compound. This packet, when so formed, may be generally a rectangular pillow of caulking material having a thickness approximately the same as the applied bead of the caulking compound. This further allows the transparent facing sidewall portions to be oriented substantially parallel to one another to reduce distortion when the substrate surface is viewed to the facing sidewall portions and caulking compound. Furthermore, index markings may be provided on the container with these index markings correlated to the linear length of a bead which may be applied by the remaining amount of caulking compound in the container, and, by proper application of these index markings, the crease line may register with these index markings to facilitate the reading thereof.

These and other objects of the present invention will become more readily appreciated and understood from a consideration of the following detailed description of the preferred embodiment when taken together with accompanying drawings, in which:

DETAILED DESCRIPTION OF THE PREFERRED EMBODIMENT

The present invention relates to a product for the building industry which broadly includes a container having a transparent sidewall portion and a substantially transparent caulking compound contained therein. The present invention is particularly directed to a flexible, squeeze tube type container which is useful for packaging relatively small quantities of transparent caulking compound in an economical manner which nonetheless allows the user to preview the appearance of the transparent caulking compound on a substrate surface prior to actually dispensing the caulking compound. It should thus be appreciated that, in its broadest form, the present invention is useful for containing any transparent caulking compound and is particularly adapted to contain viscous caulking material which has organic solvent components that are highly volatile.

Figure 1:
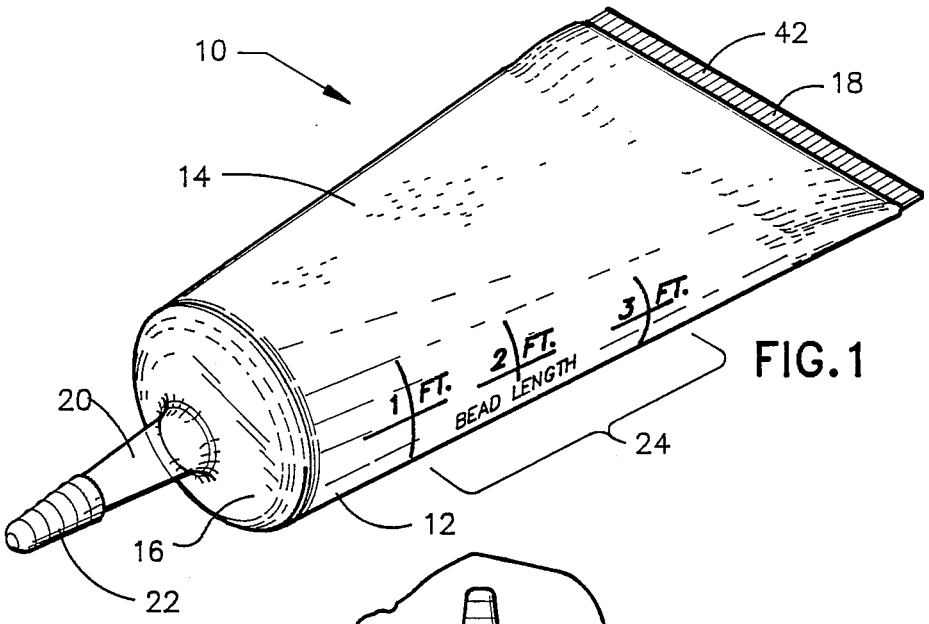
FIG. 1 is a perspective view of the materials container product for the building industry according to the preferred embodiment of the present invention.

In FIG. 1, the preferred embodiment of the present invention is shown as product 10 comprising an elongated container 12. Container 12 has a surrounding sidewall 14, a first closure 16 forming a downstream end of container 12 and a second closure 18 forming an upstream end of container 12. A dispensing nozzle 20 projects longitudinally outwardly from container 12 at the downstream end thereof so that nozzle 20 is centrally located on first closure 16. Dispensing nozzle 20 is provided a resealable mating end cap 22 to permit the resealing of container 12 after use. A plurality of index markings 24 are provided longitudinally on the side of sidewall 14 in order to indicate the amount of caulking material remaining in the container 12, as discussed more thoroughly below.

Figure 4:
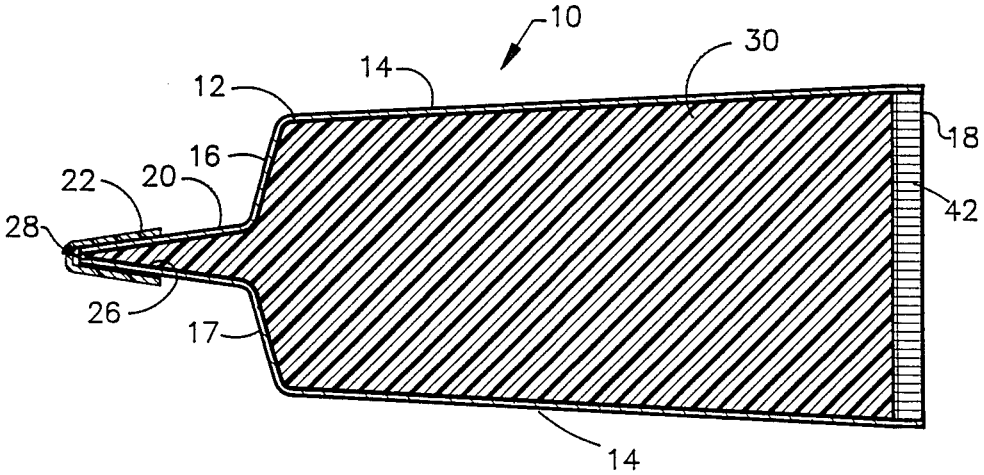
FIG. 4 is a cross-sectional view taken about lines 4—4 of FIG. 3.

As is shown in FIG. 4, the interior of container 12 is filled with a substantially transparent caulking compound 30. Dispensing nozzle 20 includes a flow passageway 26 which is in fluid communication with the interior of container 12 so that caulking compound 30 may be dispensed out of downstream outlet 28 of nozzle 20 as an applied bead of material having a dimension of the selected bead thickness corresponding to the size of downstream outlet 28.

Figure 3:
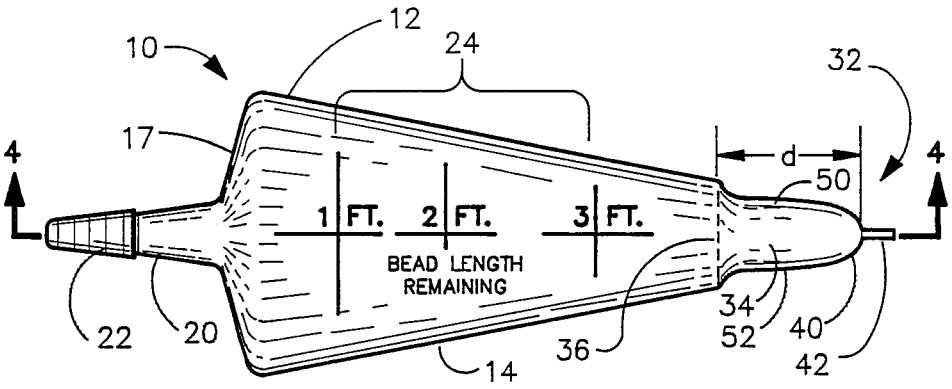
FIG. 3 is a side view in elevation of the preferred embodiment of the present invention.

As is shown in FIGS. 1, 3 and 4, container 12 is preferably formed of a flexible tubular material. Accordingly, container 12 has a generally circular cross-section adjacent first closure 16 which is defined by frustonical end wall 17. Nozzle 20 is formed integrally with end wall 17, and end wall 17 may be an integral continuation of sidewall 14. Alternately, of course, end wall 17 and sidewall 14 could be different pieces which are attached to one another in a convenient manner known in the art, such as by adhesives, ultrasonic welding, and the like. Second closure 18, on the other hand, is formed by collapsing and sealing a second end portion 40 on itself to form a sealed linear margin 42 transverse to the longitudinal axis of container 12. This seal can be accomplished again by any technique readily known in the art, such as adhesives, heat sealing, ultraonsic welding and the like.

Figure 2:
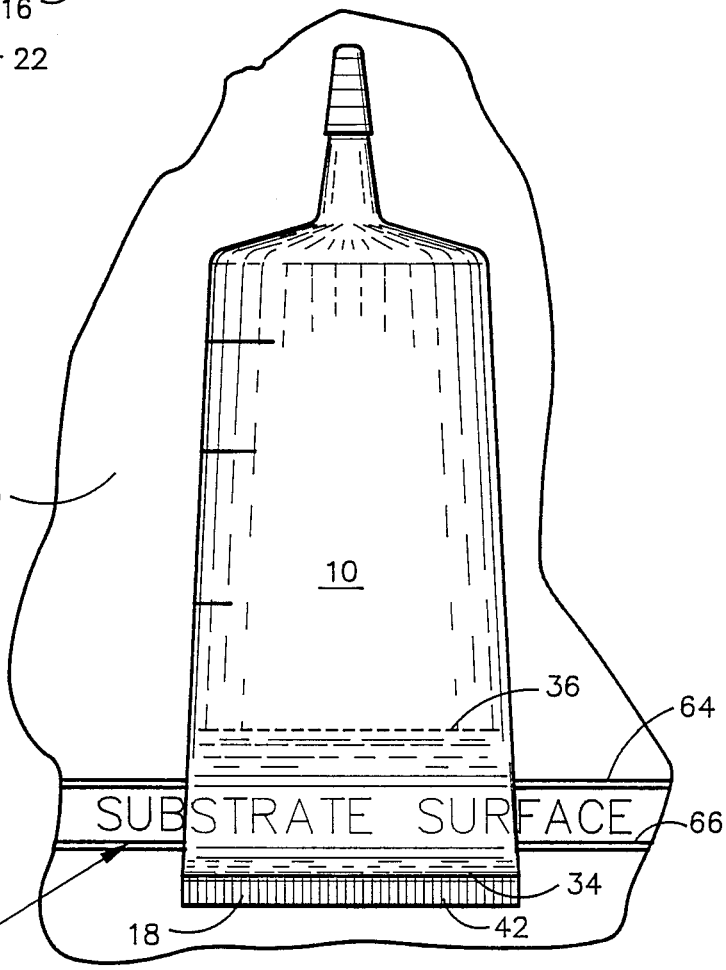
FIG. 2 is a top plan view showing the present invention above on substrate surface.

With reference now to FIGS. 2 and 3, it may readily be appreciated that, by forming sealed linear margin 42 as a collapsed portion of sidewall 14, an upstream end 32 of container 12 has a region 34 of reduced thickness in a direction transverse to the longitudinal axis. This region 34 is logitudinally adjacent the upstream end 32 of conainer 12 as defined by second closure 18. Thus, the caulking compound in this region 34 of reduced thickness has a substantially uniform, flattened configuration. This region 34 extends approximately a distance "d" from upstream end 32, and is shown in FIGS. 2 and 3, with this distance "d" preferably being approximately one inch, as is represented by phantom line 36. Sidewall 14 has opposite sidewalls 50 and 52 which face one another on opposite sides of region 34 with these sidewall portions being fabricated of substantially transparent material thus providing a window completely through container 12 and the mass 38 caulking compound contained therein. It should be understood, though, that in the preferred embodiment of the present invention sidewall 14 is completely fabricated of a transparent flexible material which may be printed with whatever graphics are desired by the manufacturer or seller. By constructing sidewall 14 out of a flexible material, furthermore, container 12 may be manually squeezed to dispense the caulking compound 30 as the applied bead out of dispensing nozzle 20 onto a selected substrate surface.

With the construction of region 34, as described above, and with reference to FIG. 2, it may now be appreciated that a substrate surface may be readily viewed through the combination of the facing sidewall portions 50, 52 and the caulking material 30 therebetween. This allows preview of the appearance of the substrate surface as it will be affected by the caulking compound before actual application of the caulking compound to the substrate. In FIG. 2, then, a substrate surface 60 is shown which, for representation purposes only, is labeled at 62 with the words "SUBSTRATE SURFACE" which is bracketed by two pairs of parallel lines 64 and 66. When product 10 is laid over the substrate surface 60, it may be seen that the transparency of region 34 allows the labeling and bracketing lines to be observed therethrough. Furthermore, it is preferable that sidewall 14 has sufficient flexibility to allow the facing sidewall portion 50 and 52 to be oriented substantially parallel to one another, thereby reducing distortion when the substrate surface is viewed through the facing sidewall portions 50, 52 and caulking compound 38 contained within region 34.

Figure 5:
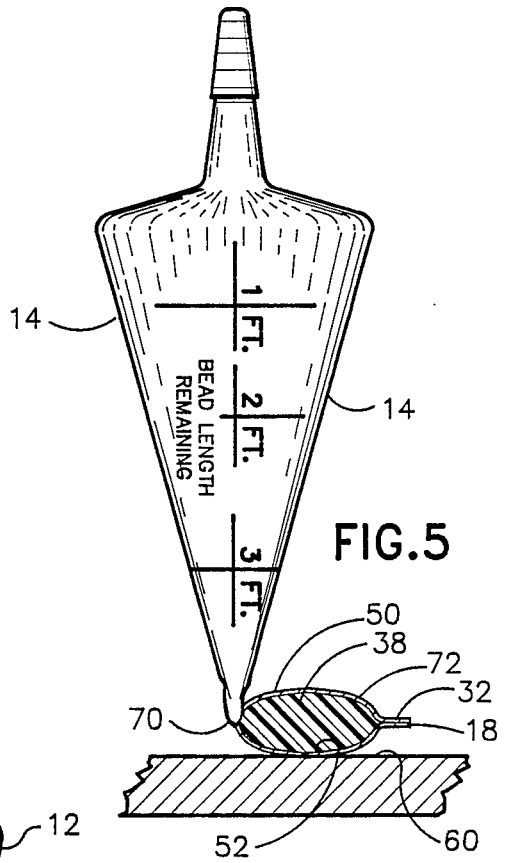
FIG. 5 is a side view in elevation and in partial cross-section of the preferred embodiment of the present invention showing in a creased configuration providing a substrate viewing packet.

With reference to FIG. 5, it should be furthermore understood and appreciated that the flexibility of sidewall 15 should be sufficient to allow sidewall 14 to be transversely creased along a crease line 70 at a location downstream of upstream end 32 in order to trap the mass 38 of caulking compound 34 between crease line 70 and a second closure 18. Thus, caulking compound 38 has a generally uniform dimensional thickness with sidewall portions 50 and 52 oriented substantially parallel to one another again reducing distortion when the substrate surface 60 is viewed therethrough. Thus, as is seen in FIG. 5, this creasing forms a packet in the shape of a generally rectangular pillow of caulking material 38 which has a thickness approximately the same as that of an applied bead of caulking material which may be dispensed through downstream outlet 28. It should thus be understood that the diameter of outlet 28 is approximately the same as the thickness of the trapped caulking compound 38 in this packet 72.

Figure 6:
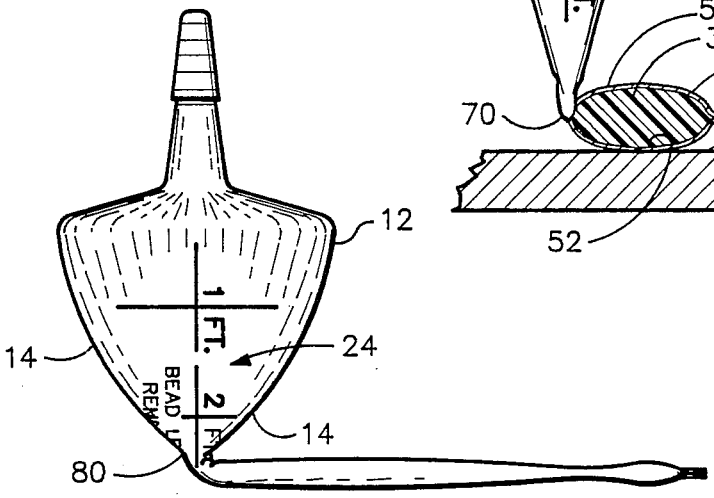
FIG. 6 is a side view in elevation of the preferred embodiment of the present invention after a portion of caulking compound has been dispensed showing the creased configuration registering with the index markings to provide a reading of the remaining caulking compound volume.

As noted above, index markings 24 are provided to indicate the amount of caulking material remaining in container 12 with these index markings being correlated to indicate the linear length of the applied caulking bead which may be dispensed from the caulking compound remaining in the container. As is shown in FIG. 6, the flexibility of sidewall 14 further may be collapsed against itself after an amount of caulking compound has been dispensed for use. Here, sidewall 14 is creased at a crease line 80 which may register with index markings 24 to indicate the amount of caulking compound remaining to be dispensed from container 12.

As discussed above, it is preferable that the caulking compound is a block copolymer rubber (thermoplastic elastomer) which physically vulcanizes by immobilization. To this end, it is preferable to form the transparent sidewall 14 as well as end wall 17 and nozzle 20 out of a high barrier transparent material which is impermeable to vapor migration. This caulking compound can be tinted with a selected color, if desired.

Figure 7:
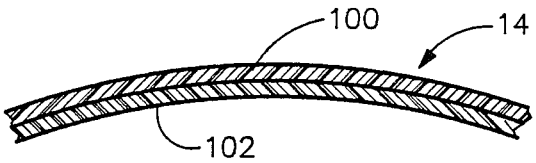
FIG. 7 is a cross-sectional view of a sidewall portion showing the laminate layering of this sidewall.

While it is possible to form sidewall 14 out of a single layer of impermeable material, such as amorphous nylon, it is also possible and within the scope of this invention to form sidewall 14 as a plurality of laminate layers, at least one of which is a layer of high barrier material, such as amorphous nylon. An example of laminate construction, as is shown in FIG. 7. Here, sidewall 14' is formed of a pair of laminate layers including an outer layer 100 and an inner layer 102. Inner layer 102 is a high barrier material resistant to the migration of vapors from the caulking compound while inner layer 100 may be constructed out of various plastic layers so that the advantages of high barrier material are obtained without the excessive cost concomitant with the high barrier materials. It is furthermore desired to match, as closely as possible, the index of refraction of the clear caulking compound 30 so that sidewalls 14 or 14' would preferably each have an index of refraction of approximately 1.45. In the laminate example, layer 100 could readily be manufactured out of polyethylene terephthalate.

As may now be fully understood, the construction described above allows purchaser or user to observe the contents of the container prior to the purchase thereof. This allows observance of any deficiency of the product, such as insufficient fill volume, and trained air bubbles impurities or particulate matter. Furthermore, and more importantly, it also allows the user or customer to view the appearance of the caulking compound as applied to a substrate surface prior to actual application of the caulking compound thereon.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A product for the building industry, comprising an elongated container having a longitudinal axis and an interior, said container including a surrounding sidewall, a first closure forming a downstream end of container and a second closure forming an upstream end of the container, a dispensing nozzle extending outwardly from said container at the downstream end thereof and having a flow passageway in fluid communication with the interior, and a substantially transparent caulking compound contained in the interior of the container, said sidewall being fabricated out of a flexible material whereby the container may be manually squeezed to dispense the caulking compound as an applied bead out of the dispensing nozzle and onto a selected substrate surface, said container having a region of reduced thickness in a direction transverse to the longitudinal axis longitudinally adjacent the upstream end of the container so that the caulking compound in the region of reduced thickness has a substantially uniform, flattened configuration and wherein said sidewall has facing sidewall portions on opposite sides of said region of reduced thickness that are fabricated of substantially transparent material whereby the substrate surface may be viewed through the combination of the facing sidewall portions and the caulking material therebetween so that the appearance of the substrate surface as affected by the caulking material may be seen prior to the application of the caulking material.

2. A product according to claim 1 wherein said sidewall is constructed entirely of transparent material.

3. A product according to claim 1 wherein said sidewall includes a layer of high barrier material resistant to migration of vapors from said caulking compound.

4. A product according to claim 3 wherein said caulking compound is a block copolymer rubber.

5. A product according to claim 3 wherein said sidewall includes layer of amorphous nylon.

6. A product according to claim 3 wherein said sidewall is constructed of laminate layers, at least one of which is said layer of high barrier material.

7. A product according to claim 1 wherein said caulking compound is tinted with a selected color.

8. A product according to claim 1 wherein said second closure is formed by collapsing a second end portion of said sidewall against itself along a linear region transverse to said longitudinal axis and sealing said sidewall second end portion together to form a sealed margin at the upstream end of the container.

9. A product according to claim 8 wherein said sidewall is a tubular member such that said upstream end is circular in cross section.

10. A product according to claim 8 wherein said sidewall has sufficient flexibility to be transversely creased along a crease line at a location downstream of said upstream end to trap a mass of caulking compound between said crease line and said sealed margin thus forming a packet of caulking compound that has a uniform dimensional thickness to facilitate preview of substrate surface as affected by the caulking compound.

11. A product according to claim 10 wherein said packet may be formed by a generally rectangular pillow of caulking material having a thickness approximately the same as the applied bead of caulking material.

12. A product according to claim 1 wherein said sidewall has sufficient flexibility to allow said facing sidewall portions to be oriented substantially parallel to one another to reduce distortion when the substrate surface is viewed through the facing sidewall portions and caulking compound.

13. A product according to claim 1 including a cap member matably received on a downstream end of said dispensing nozzle for selectably sealing and opening the passageway for respectively storing and dispensing the caulking compound.

14. A product according to claim 1 wherein said first closure and said nozzle are formed integrally with one another, said nozzle projecting longitudinally of said container and being centrally located on said first closure.

15. A product according to claim 1 wherein said first closure is formed integrally with said sidewall.

16. A product according to claim 1 including index markings on said sidewall to indicate the amount of caulking compound remaining in the container correlated to indicate the linear length of the applied bead which may be applied by dispensing the caulking compound remaining in the container.

17. A product according to claim 16 wherein said sidewall has sufficient flexibility to be collapsed against itself and creased at a crease line adjacent the caulking compound remaining in the container whereby said crease line registers with said index markings to indicate the amount of caulking compound remaining in the container.

* * * * *

US004863014B1

REEXAMINATION CERTIFICATE (2312th)

United States Patent [19]

[11] B1 4,863,014

Summons et al.

[45] Certificate Issued Jun. 7, 1994

[54] TRANSPARENT BUILDING INDUSTRY PRODUCT WITH COLLAPSIBLE TUBE

[75] Inventors: Wayne L. Summons, Littleton; Lester G. Burch, Arvada, both of Colo.

[73] Assignee: Sashco, Inc., Commerce City, Colo.

Reexamination Request:
No. 90/003,158, Aug. 12, 1993

Reexamination Certificate for:

| | |
|---|---|
| Patent No.: | 4,863,014 |
| Issued: | Sep. 5, 1989 |
| Appl. No.: | 255,840 |
| Filed: | Oct. 7, 1988 |

Related U.S. Application Data

[63] Continuation-in-part of Ser. No. 895,128, Aug. 11, 1986, Pat. No. 4,776,458.

[51] Int. Cl.[5] ..... B65D 79/00

[52] U.S. Cl. ..... 206/45.31; 206/229; 206/277; 206/459; 222/541; 220/662

[58] Field of Search ..... 220/662; 222/541; 206/45.31, 45.33, 229, 277, 459

[56] References Cited

U.S. PATENT DOCUMENTS

| | | | |
|---|---|---|---|
| 2,362,817 | 11/1944 | Haycock | 220/75 |
| 3,363,811 | 1/1968 | Gels, Sr. | 222/541 |
| 3,530,723 | 9/1970 | Hogue et al. | 220/82 R |
| 3,716,169 | 2/1973 | Chivers | 220/82 R |
| 3,884,396 | 5/1975 | Gordon et al. | 222/541 |
| 4,299,329 | 11/1981 | Keiji | 220/541 |
| 4,545,483 | 10/1985 | Shiba et al. | 220/82 R |
| 4,571,410 | 2/1986 | Nevins et al. | 523/122 |
| 4,623,677 | 11/1986 | Nevins et al. | 523/122 |

OTHER PUBLICATIONS

"DIY Retailing" magazine, Jul. 1985, pp. 5–9 (advertisement from G.E. Silicone Sealants).
"Packaging Encyclopedia", Mar. 1987, pp. 124–126, 207–209.
"Hardware Age", Feb. 1986, vol. 223, No. 2 (advertisement).
"National Home Center News", Aug. 10, 1987, p. 180 (Article re Sashco clear caulk).
"Do it Yourself Retailing", Jun. 1986, p. 136 (advertisement).
"Do It Yourself Retailing", Mar. 1987.
"Hardware Age", Jul. 1986, p. 54.

*Primary Examiner*—Joseph Man-Fu Moy

[57] ABSTRACT

A product for the building industry includes a container having opposed transparent sidewall portions and a transparent caulking compound contained therein so that the appearance of a substrate surface with the caulking compound may be previewed before actual application of the caulk. A dispensing nozzle is provided at a downstream end and has a resealable cap. The container has a flexible sidewall that is flattened at an upstream end to form a region of reduced thickness so that a mass of caulking compound therein has a flattened configuration with this mass confined between the facing transparent sidewall portions. Preferably the entire sidewall is transparent and has index markings correlated to available bead length of the caulk remaining in the container. The flexible sidewall permits manual dispensing and allows a crease to be made thereby forming a preview packet.

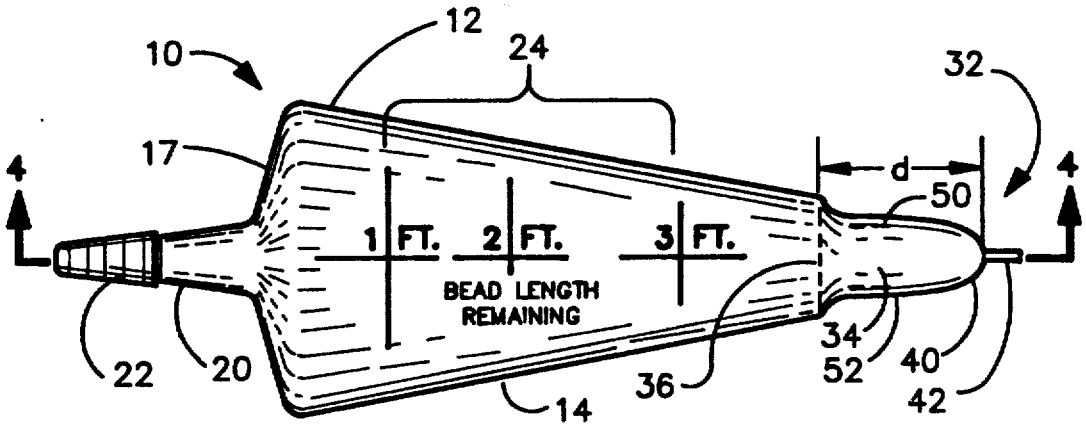

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-17 is confirmed.

* * * * *